US007140134B1

(12) United States Patent
Flagg

(10) Patent No.: US 7,140,134 B1
(45) Date of Patent: Nov. 28, 2006

(54) MODULAR TABLE TOP DISPLAY APPARATUS

(76) Inventor: Rodger H. Flagg, 10504 Daysailer Dr., Fairfax Station, VA (US) 22039

( * ) Notice: Subject to any disclaimer, the term of this patent is extended or adjusted under 35 U.S.C. 154(b) by 0 days.

(21) Appl. No.: 10/673,432

(22) Filed: Sep. 30, 2003

(51) Int. Cl.
*A47B 5/00* (2006.01)
*G09F 5/02* (2006.01)

(52) U.S. Cl. ..... 40/607.14; 108/152

(58) Field of Classification Search ..... 108/90, 108/152, 60, 61, 50.01; 211/180; 312/196; 160/351; 248/231.71, 229.25; 40/607.14
See application file for complete search history.

(56) References Cited

U.S. PATENT DOCUMENTS 3,494,405 A * 2/1970 Sandahl et al. ..... 312/196
3,517,822 A * 6/1970 Wagner ..... 160/351
5,609,112 A * 3/1997 Meyer et al. ..... 108/153
D456,182 S * 4/2002 Hamilton et al. ..... D6/491
6,568,335 B1 * 5/2003 Hamilton et al. ..... 108/50.02

* cited by examiner

*Primary Examiner*—Cassandra Davis

(57) ABSTRACT

A modular table top display having a first upright sub-assembly, a second upright sub-assembly, and upper and lower horizontal cross-members, which extend between the first and second upright sub-assemblies, to span the desired length of the table top. A horizontal cross member extension may be selectively used to extend the length of the display apparatus for longer displays. A flexible sheet material with indicia thereon is releasably secured to the modular table top display apparatus at assembly, and may be rolled up for transport or storage. A clamp extends beneath the table top to secure each of the first and second upright sub-assemblies directly to the table top. Optional lighting may be supported by the rigid frame. The modular table top display apparatus my be disassembled and compactly stored in a carrying case or bag, for ease of transport and storage.

19 Claims, 8 Drawing Sheets

MODULAR TABLE TOP DISPLAY APPARATUS

BACKGROUND OF THE INVENTION

There are many types of display devices known in the art. One popular type of display device is known as the pop-up display. Pop-up displays have been adapted for floor use as well as for table top use. These devices have multiple arms which pivot and expand to support graphics or other indicia. They are light weight, compact and portable, but require a foot print that takes up hundreds of square inches of the available table area, and are expensive to make.

There are rigid panel displays, which fold for transport or storage, and fold out to rest upon a table top. These also take up substantial table space when erected upon a table, and viewing from the side is partially restricted.

There are vertical roll-up displays similar to a projection screen. Vertical roll up displays are supported from the floor and not adapted for securement to a tabletop. Roll up displays are best used indoors, as the vertical sides of the display are not supported, and tend to twist and flutter in the wind.

Inflatable displays are also known, which are supported from the floor. These displays are very compact when deflated, but will deflate during use, if accidentally punctured, and require a large footprint to support the display.

Rigid frames have been used to support graphics or indicia. Rigid frames are usually supported upon a wall, or other vertical support, and will easily fall over in a gust of wind, if placed upon a table top without additional support.

Many trade shows and conventions take place in Hotels, Convention Centers, and indoor or outdoor common areas. The vendor is often limited in usable display space to a six foot or eight foot long table. Some trade shows require the vendor's display to be placed only upon the table top, and restrict use of floor mounted displays.

Therefore, what is needed is a compact, portable modular display apparatus, which is attractive and eye catching, is easily set up or taken down without tools, requires a minimum of table top space, is clamped directly to the tabletop and not supported from the floor, requires a minimum footprint on the table top, is adjustable to suit the length of the table top, provides optional lighting, and will withstand gusts of wind without falling down.

SUMMARY OF THE INVENTION

The present invention relates to a modular table top display apparatus having a first upright sub-assembly, a second upright sub-assembly, and upper and lower horizontal cross-members, which extend between the first and second upright sub-assemblies, to span the desired length of the table top. More than one horizontal cross member may be used to extend the length of the display apparatus for longer displays. A flexible sheet material with indicia thereon is releasably secured to the modular table top display apparatus at assembly, and may be rolled up for transport or storage. A clamp means extends beneath the table top to releasably secure each of the first and second upright sub-assemblies directly to the table top. Optional lighting may be supported by the rigid frame. The modular table top display apparatus my be disassembled and compactly stored in a carrying case or bag, for ease of transport and storage.

DETAILED DESCRIPTION OF THE PREFERRED EMBODIMENT(S)

Figure 1:
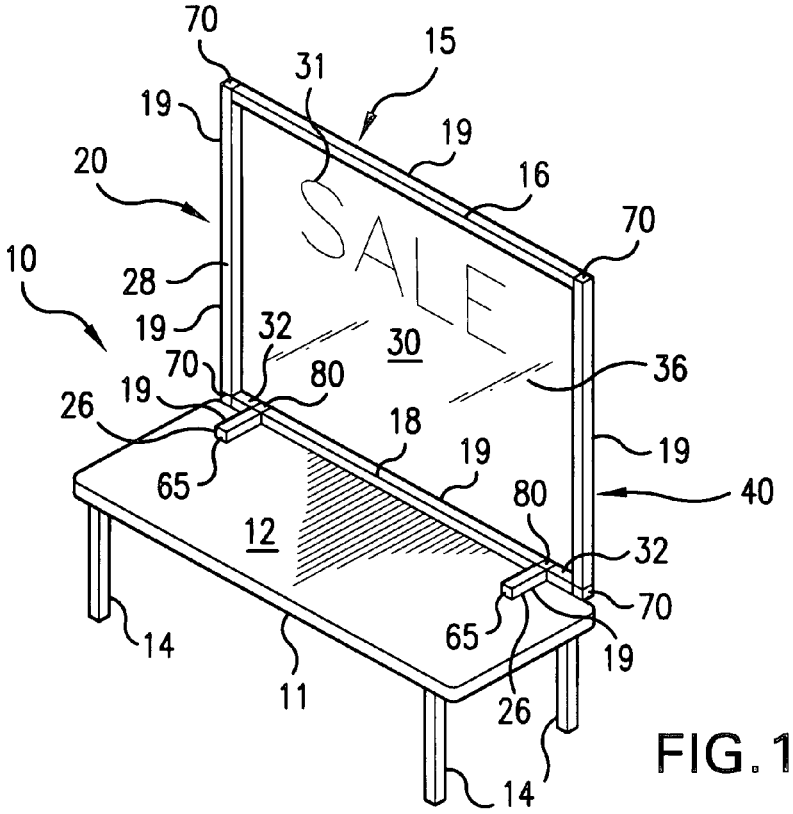
FIG. 1 is a front perspective view of the modular table top display apparatus mounted upon a tabletop, with offset clamping means, and a pliable display sheet releasably secured behind the frame.
Figure 2:
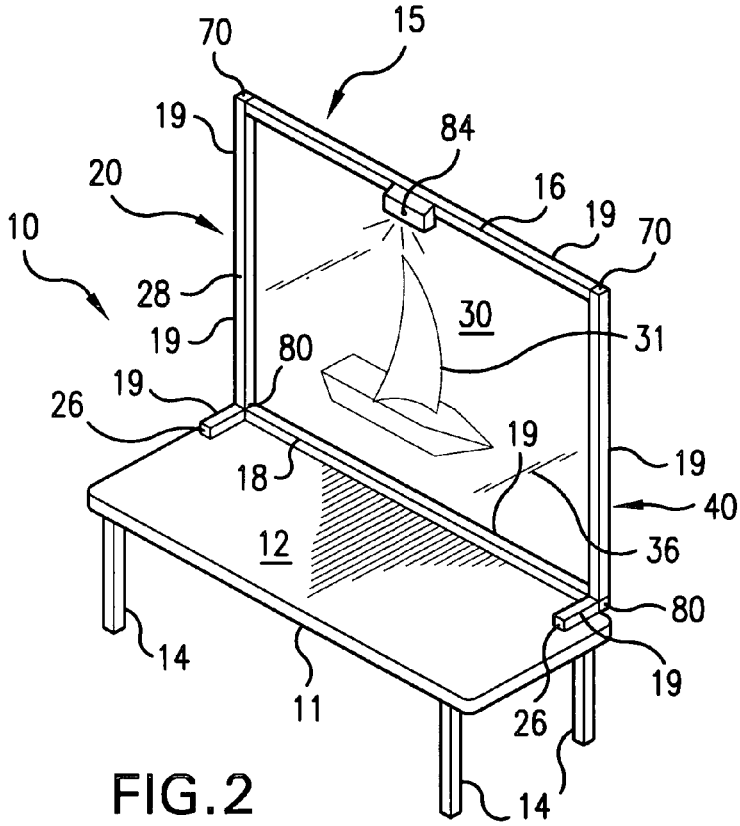
FIG. 2 is a front perspective view of the modular table top display apparatus mounted upon a tabletop, with in-line clamping means.

As shown in FIG. 1 through FIG. 9, the modular table top display apparatus 10 is easily configured to substantially fit the length of a new or existing table top 12. The frame 15 is made of tubular members 19, which are each preferably square or rectangular in shape, although other shapes, such as round, oblong or multi-sided may alternately be used. The tubular members 19 are preferably made of aluminum for strength and light weight, although other metals or plastics may alternately be used without departing from the scope of this invention, or from the following claims.

Straight connectors 60, right angle connectors 70 and four-way connectors 80 are used to connect the frame 15 at assembly.

Upper and lower horizontal cross-members 16, 18 extend between the first upright sub-assembly 20 and the second upright sub-assembly 40. The upper and lower horizontal cross-members 16, 18 may be releasably joined together at assembly with a slip fit connection 61 to provide a variety of lengths to suit the desired length of the modular table top display apparatus 10. See FIG. 3.

For example, approximately three foot long upper and lower horizontal cross members 16, 18 may be used to make a three foot long table top display apparatus 10, or two approximately three foot long upper and lower horizontal cross members 16, 18 may be joined with a straight connector 60 to make a six foot long modular table top display apparatus 10. Alternately, one approximately six foot long horizontal cross member 16, 18 may be used to make a six foot long modular table top display apparatus 10.

Figure 3:
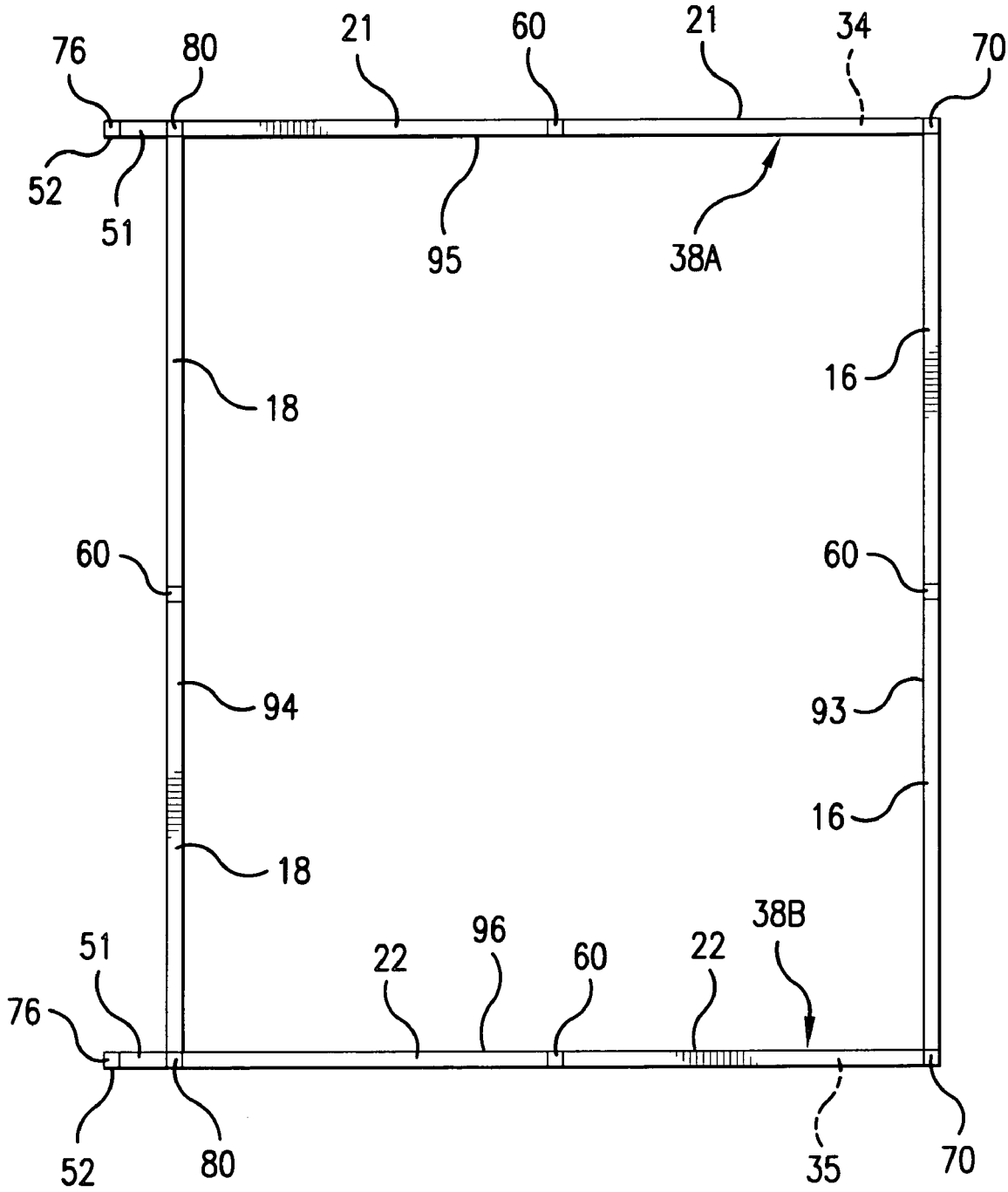
FIG. 3 is a front view of the modular table top display apparatus showing the use of more than one upper and lower horizontal cross member extensions, and the use of more than one vertical tubular members.

Likewise, one approximately four foot long upper and lower horizontal cross member 16, 18 may be used to make a four foot long modular table top display apparatus 10. Two approximately four foot long upper and lower horizontal cross members 16, 18 may be joined together with a straight connector 60 to make an eight foot long modular table top display apparatus 10, or one approximately eight foot long upper and lower horizontal cross members 16, 18 may be used. Any combination of lengths of upper and lower horizontal cross members 16, 18 may be used and releasably connected together to achieve a selected table top 12 length. Two upper horizontal cross members 16 are shown in FIG. 3. Likewise, two lower horizontal cross members 18 are shown in FIG. 3. Preferably, an elastomeric cord 66 joins two adjacent upper horizontal cross members 16 together, for ease of assembly. Likewise, an elastomeric cord 66 joins two adjacent lower horizontal cross members 18 together, for ease of assembly. The elastomeric cord 66 may be secured either directly to the cross members 16, 18 or to adjoining connectors, to suit manufacturing preference. When used, the elastomeric cords 66 serve to keep adjacent cross members together during assembly, and simplify alignment of complimentary parts.

Likewise, where two vertical members 21, 22 are used in each of the first and second upright sub-assemblies, they are joined together with a straight connector 60. The two vertical members 21, 22 are preferably joined together at assembly with a slip fit connection 61 to provide a variety of heights to suit the desired height of the modular table top display apparatus 10. An elastomeric cord 66 may be secured either directly to the vertical members 21, 22 or to the adjoining connector 60, to suit manufacturing preference. When used, the elastomeric cords 66 serve to keep adjacent vertical members 21, 22 together during assembly, and simplify alignment of complimentary parts.

Figure 6A:
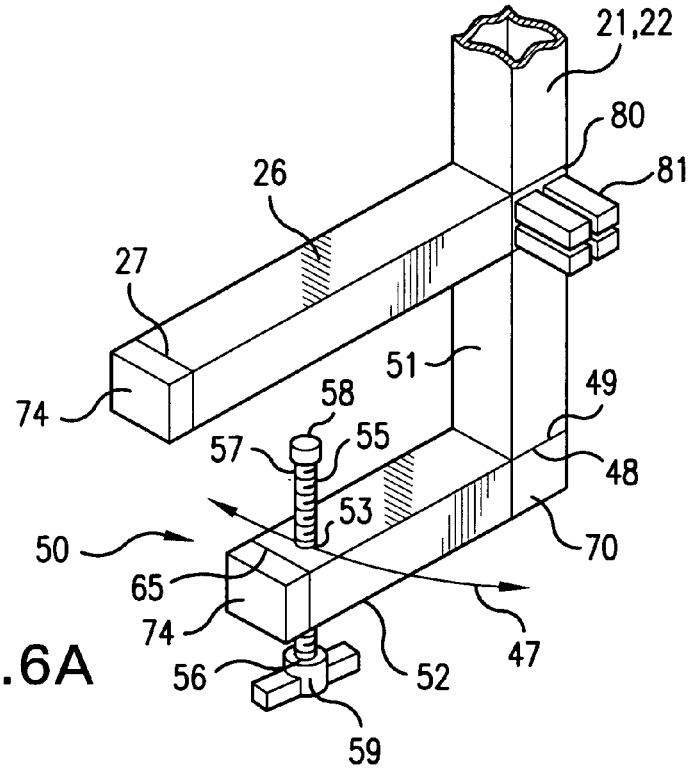
FIG. 6A is a partial front perspective view of the first upright sub-assembly showing the clamping means inline with the first tubular member, and the horizontal clamping arm is preferably pivotally secured to the lower extension member.

FIG. 6A shows a partial side view of the first upright sub-assembly 20, showing in detail the table top brace 26, and the clamping means 50 aligned with the first vertical tubular member 21, 22. The clamping means 50 comprises a lower extension 51 and a clamping arm 52 either rigidly secured 46 or pivotally secured 48 to the lower end 49 of lower extension 51 beneath the table top 12. Preferably, the horizontal clamping arm 52 is pivotally secured 48 to aid in positioning the clamping means 50 on the underside of the table top 13 to avoid obstacles located on the underside of the table top 13. The horizontal clamping arm 52 is preferably shorter than the table top brace 26 to position the camping means 50 between the distal end 27 of the table top brace 26 and the frame portion 15 of the modular table top display apparatus 10.

Figure 4A:
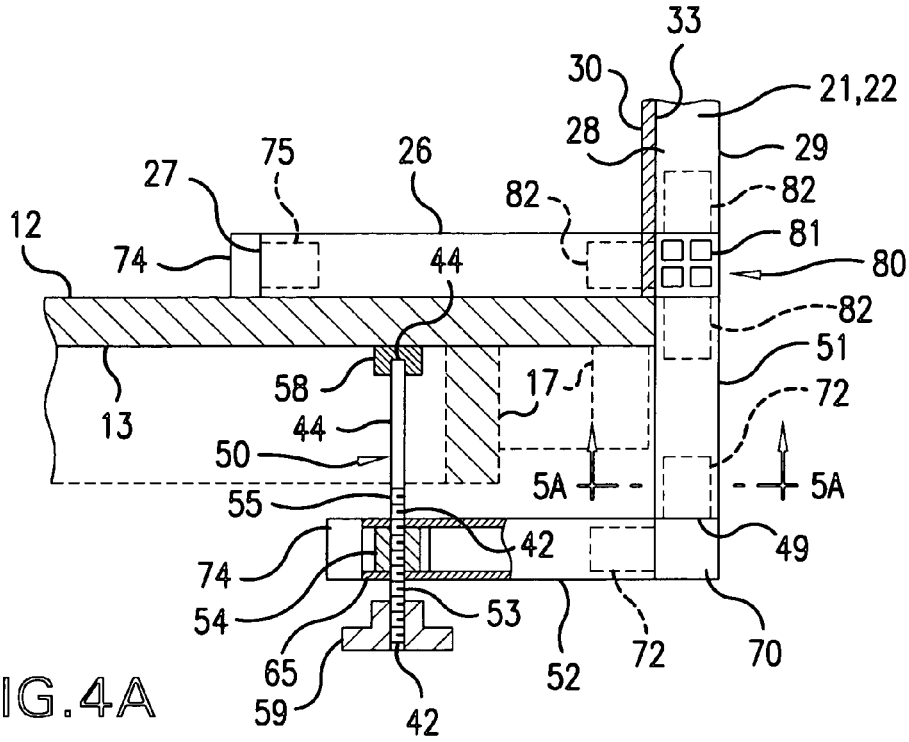
FIG. 4A is a partial side view of the first upright sub-assembly, showing the clamping means releasably secured to the table top.
Figure 4B:
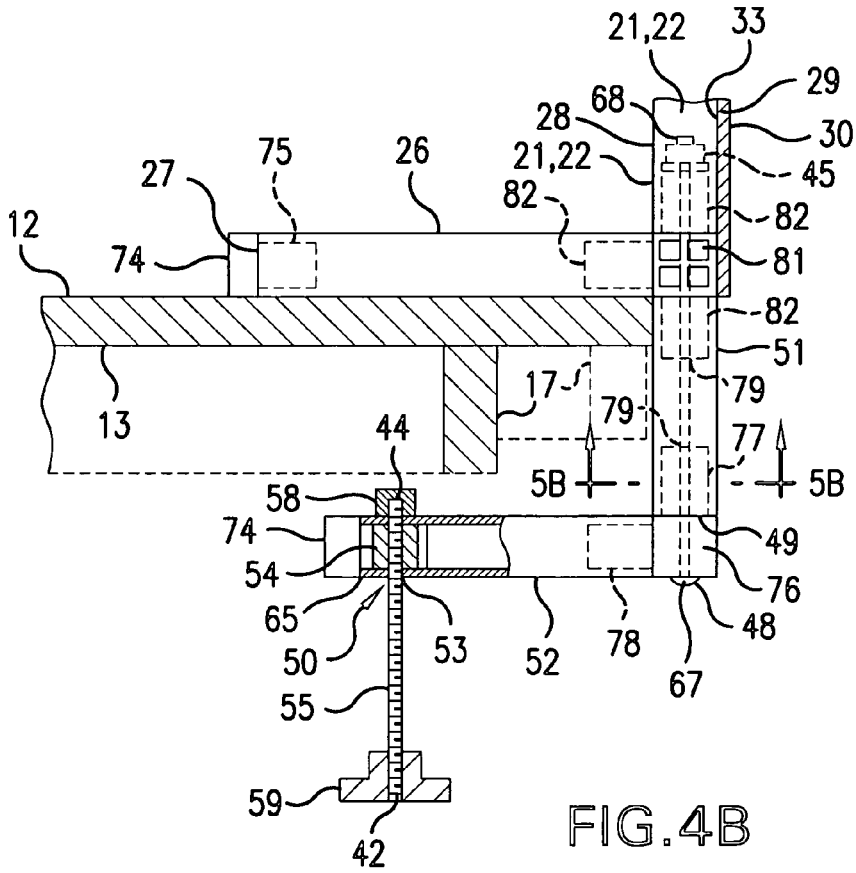
FIG. 4B is a partial side view of the first upright sub-assembly, showing the clamping means lowered to clear the depending lip of the table top.
Figure 5A:
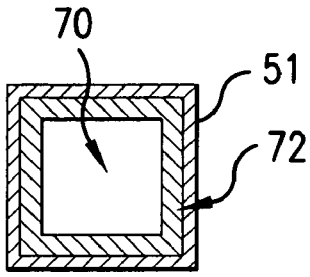
FIG. 5A is a cross sectional view of a non-pivoting clamping means taken along lines 5—5 in FIG. 4.
Figure 5B:
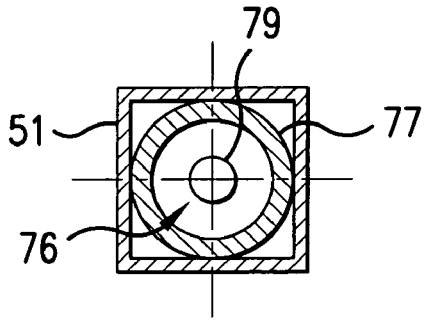
FIG. 5B is a cross sectional view of a pivoting clamping means taken along lines 5—5 in FIG. 4.
Figure 5C:
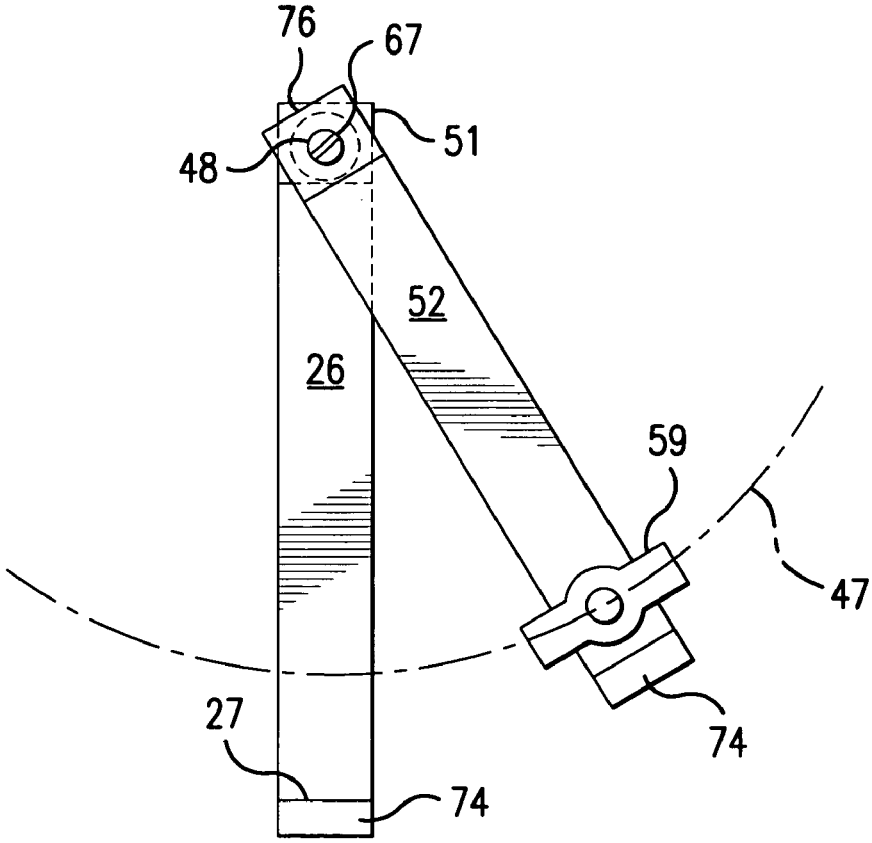
FIG. 5C is a bottom view of a pivoting clamping means, which pivots to a preferred location beneath the table top, to obtain a more suitable clamping position.

As shown in FIG. 4A and FIG. 4B, a vertical aperture 53 extends through the horizontal clamping arm 52 at a position near the distal end 65 of the clamping arm 52. A threaded nut 54 is secured within the clamping arm 52, in alignment with the vertical aperture 53. A threaded rod 55 threadably engages the threaded nut 54, and extends through the vertical aperture 53. A handle 59 is secured to the lower end 42 of the threaded rod 55. When the handle 59 is rotated in a first direction, the threaded rod 55 selectively raises to engage the underside of the table top 13, to releasably secure the modular table top display apparatus 10 to the table top 12.

When the handle 59 is rotated in the opposite direction, the threaded rod 55 is lowered to clear the depending lip 17 of the table top 12. The upper portion 44 of the threaded rod 55 may be undercut to slip through the threaded nut 54 without engaging the threads, to more rapidly position the threaded rod 55 in proximity to the underside of the table top 13. The remaining threads on the threaded rod 55, are positioned to engage the threads on the threaded nut 54 as the distal end 68 of the threaded rod 55 comes near the underside of the table top 13.

Figure 6B:
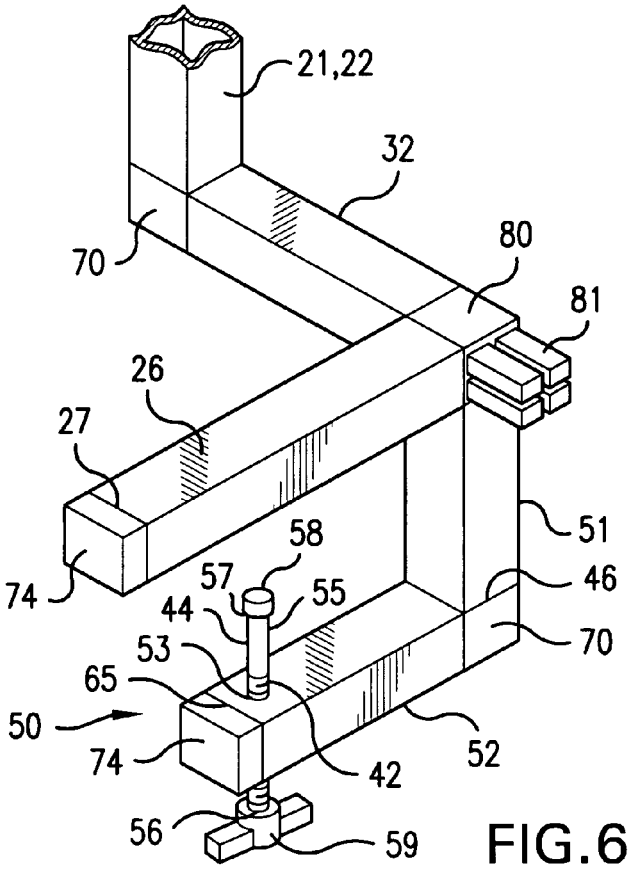
FIG. 6B is a partial front perspective view of the first upright sub-assembly, showing the clamping means offset from the end of the first upright sub-assembly, to better position the clamping assembly away from the edge of the table top.
Figure 7A:
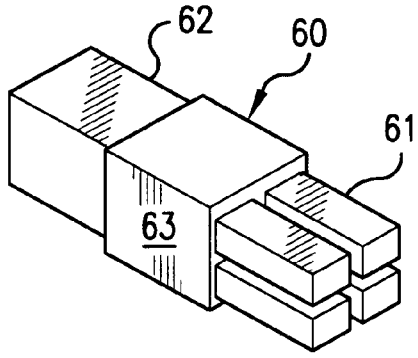
FIG. 7A is a perspective view of a straight connector.
Figure 7B:
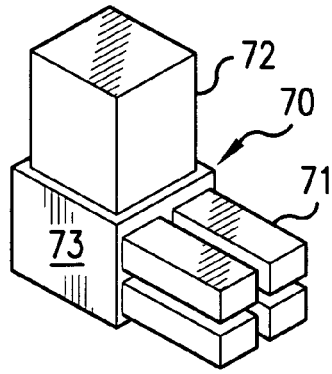
FIG. 7B is a perspective view of a right angle connector.
Figure 7C:
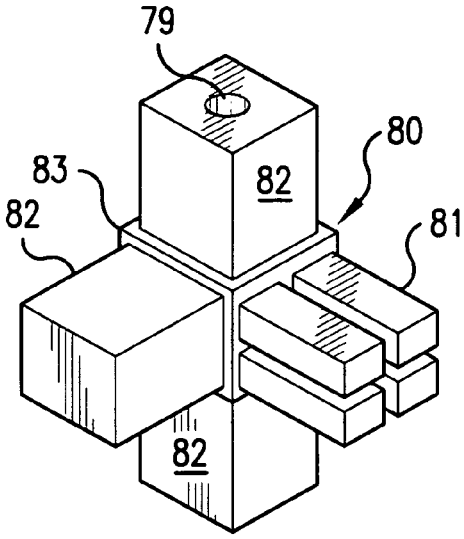
FIG. 7C is a perspective view of a four way connector with a central slip fit connection.
Figure 7D:
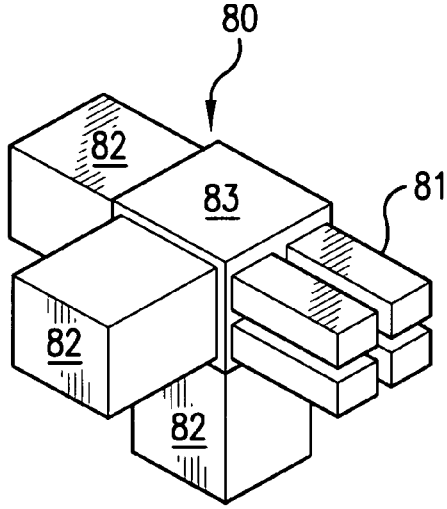
FIG. 7D is a perspective view of a four way connector with an end slip fit connector.
Figure 7E:
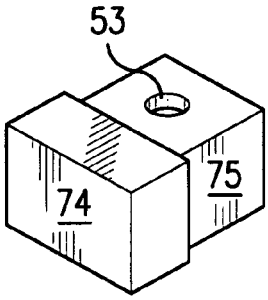
FIG. 7E is a perspective view of an end connector with a vertical aperture extending therethrough.
Figure 7F:
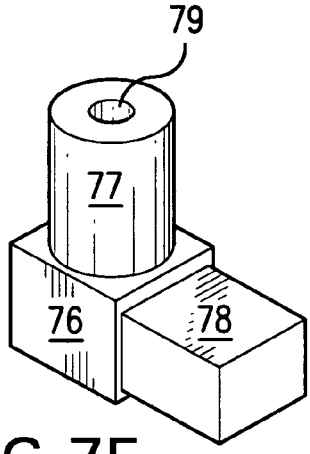
FIG. 7F is a perspective view of an alternate right angle connector with a circular end and a press fit end, with an aperture extending through the circular end of the connector.

The clamping means 50 may extend directly below the vertical tubular member(s) 21, 22, as shown in FIG. 6A, or the clamping means 50 may be offset from the vertical sides of the first and second sub-assemblies 20, 40 to better avoid the lower lip 17 of the table top 12, as shown in FIG. 6B. (Note that many existing table tops 12 have the lower lip 17 located in different locations on the underside of the table top 13). The clamping arm is preferably offset at least four inches inward of the opposing ends to avoid obstacles located beneath the table top.

On most existing table top 12 assemblies, the lower lip 17 extends flush, or up to three and one half inches from the outer edge of the table top 12, and extends up to three inches below the underside of the table top 13. Thus, the offset clamping means 50 is preferably positioned to avoid such obstacles located beneath most existing table tops 12. See FIG. 4A and FIG. 4B.

The modular table top display apparatus 10 is sized to fit upon the selected table top 12, with a height of the modular table top apparatus 10 sized to receive the flexible sheet material 30 to be displayed thereon. Most banner manufacturers have sign printing machines capable of making flexible sheet material 30 up to sixty inches in width. Larger flexible sheet material 30 may be made by joining two or more panels of flexible sheet material 30 together with a seam (not shown).

Preferably the modular table top display apparatus 10 is sized to extend from one to six inches less than the length of the table top 12, to ensure a better clamping location when the first and second upright sub-assemblies 20, 40 are releasably secured to the table top 12.

The height of the modular table top display apparatus 10 is dependent on the height of the vertical member(s) 21, 22 used in the respective first and second upright sub-assemblies 20, 40. The vertical tubular members 21, 22, used for the respective first and second upright sub-assemblies 20, 40 may each be two tubular members 21 or 22 joined by one or more straight connectors 60, having at least one slip fit end 61 which is sized to slip fit 61 together at assembly. Other known means of releasable securement may alternately be used, without departing from the scope of this specification, or the following claims. This reduces the overall size of the dismantled modular table top display apparatus 10, which is beneficial for transport and storage.

The flexible sheet material 30 is sized to fit the desired height and length of the frame 15, and is pliable so that it may be easily rolled up for ease of transport and storage. The flexible sheet material 30 may be a pliable plastic, fabric, paper or cloth material on which graphics and other indicia 31 may be printed, painted, drawn, or otherwise secured thereon. A vinyl material 36 may be used. The indicia 31 may be any color or combination of colors, and may include photo image(s), printed matter, letters, numbers, symbols, names, trademarks, etc.

When unrolled, the flexible sheet material 30 is releasably secured to the frame 15 of the modular table top display apparatus 10 along the front side 28 or the rear side 29 of the first and second upright sub assemblies 20, 40, and to the respective upper and lower horizontal cross members 16, 18. The flexible sheet material 30 is releasably secured 32 with a releasable securement means 33, such as hook and loop type fasteners, magnetic strips, clamps, double sided releasable adhesive, or other known releasable securement means 33. The releasable securement means 33 may be positioned in continuous or spaced strips along the frame 15 and along complimentary sides of the flexible sheet material 30.

A first and/or second rigid member 34, 35 such as a bar, rod, angle, channel, or other selected elongated shape may be used on at least one side of the flexible sheet material 30 for ease of assembly. The rigid members 34, 35 are secured to opposing sides 38A, 38B of the flexible sheet material 30.

At assembly, one of the rigid members 34, 35 is positioned at one of the opposing sides 38A, 38B of the frame 15, and then the flexible sheet material 30 is drawn taut and releasably secured to the opposing side 38A, 38B of the frame 15. When not in use, the flexible sheet material 30 may be rolled up upon the rigid member(s) 34, 35 and may be stored with other component parts of the modular table top display assembly 10, or rolled and placed in a separate container, to suit user preference.

FIG. 4A is a partial rear perspective view of the modular table top apparatus 10 showing the clamping means 50 for releasably securing the first and second upright sub-assemblies 20, 40 to the table top 12, with the flexible sheet material 30 releasably secured to the front of the frame 15.

The non-rotating clamping means 50 comprises a lower vertical extension 51, a right angle connector 70 press fit into the lower end 49 of lower extension 51, and a horizontal clamping arm 52 press fit into the second end of the right angle connector 70. A vertical aperture 53 extends through the horizontal clamping arm 52, near the distal end 65 of the horizontal clamping arm 52. A threaded nut 54 is secured within the horizontal clamping arm 52 in alignment with the vertical aperture 53. A threaded rod 55 threadably engages the threaded nut 54. The lower end 42 of the threaded rod 55 is secured to a handle 59, so that when the handle 59 is rotated, the threaded rod 55 selectively rises or lowers in relation to the threaded nut 54. A cap 58 may be provided at the upper end 44 of the threaded rod 55, as shown in FIG. 6A and FIG. 6B to avoid marring the underside 13 of the table top 12.

Preferably, the horizontal clamping arm 52 is pivotally secured 48 with a threaded bolt 67 and a nut 45 in relation to the lower vertical extension 51, to better position the threaded rod 55 to avoid obstacles located beneath the table top 12. (See FIG. 5B).

The modular table top apparatus 10 disclosed herein, requires a minimum of table top 12 space. Where the table top braces 26 are each about one inch wide by about six inches long, the modular table top apparatus 10 takes just twelve inches of the table top space, leaving 2,160 usable square inches of table top space unused on a standard 30 inch by 72 inch table. Of course, other lengths and widths of table top brace 26 may be used, without departing from the scope of this disclosure, or from the accompanying claims.

Most existing table top displays require a much greater percentage of table top space, to support the table top display, leaving less usable table top space to display other useful items, such as catalogs, pricing sheets, samples, photo's, etc. (not shown).

The modular table top display apparatus 10 is supported upon a suitable table top 12. The modular table top display apparatus 10 comprises a first upright sub-assembly 20, with at least one vertical tubular member 21, 22. A right angle connector 70 is secured to the upper end of the vertical tubular member 21, and a lower connector (70 or 80) is secured to the lower end of the vertical tubular member 21, 22.

A first clamping means 50 is positioned beneath the first upright sub-assembly 20. The first clamping means 50 includes a horizontal table top brace 26, a depending lower extension 51, and a horizontal clamping arm 52 with a vertical aperture 53 located near the distal end 65 of the horizontal clamping arm 52. A threaded nut 54 is secured within the horizontal clamping arm 52 in alignment with the vertical aperture 53. A threaded rod 55 engages the threaded nut 54, and the threaded rod 55 extends through the vertical aperture 53. A handle 59 is secured to the threaded rod 55 at a location beneath the horizontal clamping arm 52.

The threaded rod 55 is sized to engage the underside of the table top 13 when the handle 59 is tightened, and to clear the depending lip 17 of the table top 12 when the handle 59 is loosened. A cap 58 preferably covers the distal end of the threaded rod 55, to avoid marring the underside of the table top 13.

A second upright sub-assembly 40 has at least one vertical tubular member 21, 22. A right angle connector 70 is secured to the upper end of the vertical tubular member 21, and a lower connector (70 or 80) is secured to the lower end of the vertical tubular member 21 or 22.

A second clamping means 50 is positioned beneath the second upright sub-assembly 40. The second clamping means 50 includes a horizontal table top brace 26, a depending lower extension 51, and a horizontal clamping arm 52 with a vertical aperture 53 located near the distal end 65 of the horizontal clamping arm 52. A threaded nut 54 is secured within the horizontal clamping arm 52 in alignment with the vertical aperture 53. A threaded rod 55 engages the threaded nut 54, and extends through the vertical aperture 53. The threaded rod 55 is sized to engage the underside of the table top 13 when the handle 59 is tightened, and to clear the depending lip 17 of the table top 12 when the handle 59 is loosened.

At least one upper horizontal cross member(s) 21, 22, is/are sized to extend between the right angle connector 70 secured to the upper end 23 of the first upright sub-assembly 20 and the right angle connector 70 secured to the upper end 23 of the second upright sub-assembly 40.

At least one lower horizontal cross member(s) 18 is/are sized to extend between the lower connector (70 or 80) secured to the lower end of the first upright sub-assembly 20 and the lower connector (70 or 80) secured to the lower end of the second upright sub-assembly 40.

A flexible sheet material 30 is sized to be releasably secured to the vertical tubular member 21, 22 on the first upright sub-assembly 20, the vertical tubular member 21, 22 on the second upright sub-assembly 40, the upper horizontal cross member(s) 16 and the lower horizontal cross member (s) 18. The flexible sheet material 30 may be rolled up when not in use, for ease of transport and storage. A rigid member 34, 35 may be positioned on opposing sides 38A, 38B of the flexible sheet material 30 for ease of assembly. The flexible sheet material 30 may be rolled up around the rigid member 34,35 for ease of transport and storage.

The horizontal clamping arms 52 of the first and second upright sub-assemblies 20, 40 are optionally pivotally secured 48 with a suitable fastener in relation to the respective first and second upright sub-assemblies 20, 40, to better position the clamping means 50 to avoid various obstacles located on the underside of the table top 13.

More than one vertical tubular member(s) 21, 22 may be used to extend the height of the respective first and second upright sub-assemblies 20, 40, and to provide a more compact disassembly, for ease of transport or storage.

Likewise, more than one horizontal cross member(s) 16, 18 may be used to extend the length of the modular table top display apparatus 10 to provide a more compact disassembly, for ease of transport or storage.

One or more light fixtures 84 may be releasably secured to the upper portion of the frame 15, to provide improved lighting to the modular table top display apparatus 10. A multiple light cord assembly 86 may be secured to the lower portion 93 of the upper horizontal cross member 16, the upper portion 94 of the lower horizontal cross member 18, the inner side 95 of the first vertical tubular member 21, and the inner side 96 of the second vertical tubular member 22, thus forming a substantially continuous light cord assembly 86 having multiple points of light 89 positioned within the frame 15 portion of the modular table top display apparatus 10. The multiple light cord assembly 86 is a two or three wire multiple light cord assembly 86, secured to the frame 15 with a U-shaped channel member 92. A controller 88 is provided to selectively turn the multiple light cord assembly 86 on or off, to blink the multiple light cord assembly 86 off and on, and to create the illusion that the lights within the multiple light cord assembly 86 are moving in a selected direction.

At least one end of each straight connector 60, right angle connector 70, and four way connector 80 is preferably slotted in at least one direction to provide a slip fit connection 61, 71, 81. Alternately, the slip fit connection 61, 71, 81 on each straight connector 60, right angle connector 70, and/or four way connector 80 is ground or machined to provide a slip fit connection 61, 71, 81.

As shown in FIG. 4A and FIG. 4B, an end connector 74 is preferably provided to close off the distal end 27 of each table top brace 26 and the distal end 65 of each horizontal clamp arm 52. The end connector 74 on the horizontal clamp arm 52 may also aid in securing the threaded nut 54 within the distal end of the horizontal clamp arm 52.

The position of the table top brace 26, the lower extension 51 and the horizontal clamp arm 52 is preferably offset in relation to the vertical tubular member 21, 22 on each of the first and second upright sub-assemblies 20, 40 to position the horizontal clamp arm 52 at least four inches inward of the opposing ends 24 of the table top 12. See FIG. 6B.

The modular table top display apparatus 10 disclosed herein is easily assembled and disassembled without the use of tools. The component parts may be easily disassembled and brought together for storage in a suitable container or bag 90, for ease of transport or storage.

When needed, the modular table top display apparatus 10 may be quickly assembled upon a table top 12 or floor. The component parts are removed from the container 90, and the first and second vertical sub assemblies 20, 40 are assembled if multiple vertical tubular members 21, 22 are used. Then horizontal cross members 16, 18 are assembled to the respective connectors on the first and second upright sub-assemblies 20, 40. The flexible sheet material 30 is then aligned and secured to the frame 15, either on the back side 23 of frame 15 as shown in FIG. 4B, or on the front side 25 of frame 15, as shown in FIG. 4A.

The assembled frame 15, with flexible sheet material 30 assembled thereon, is then raised to a vertical position, and the table top braces 26 positioned on the table top 12. The user then secures the first and second clamping means 50 beneath the table top 12, to secure the entire modular table top display assembly 10 to the table top 12. Lighting 84, 92 may be added as needed, either before or after installing the modular table top display apparatus 10 upon the table top 12.

Figure 8A:
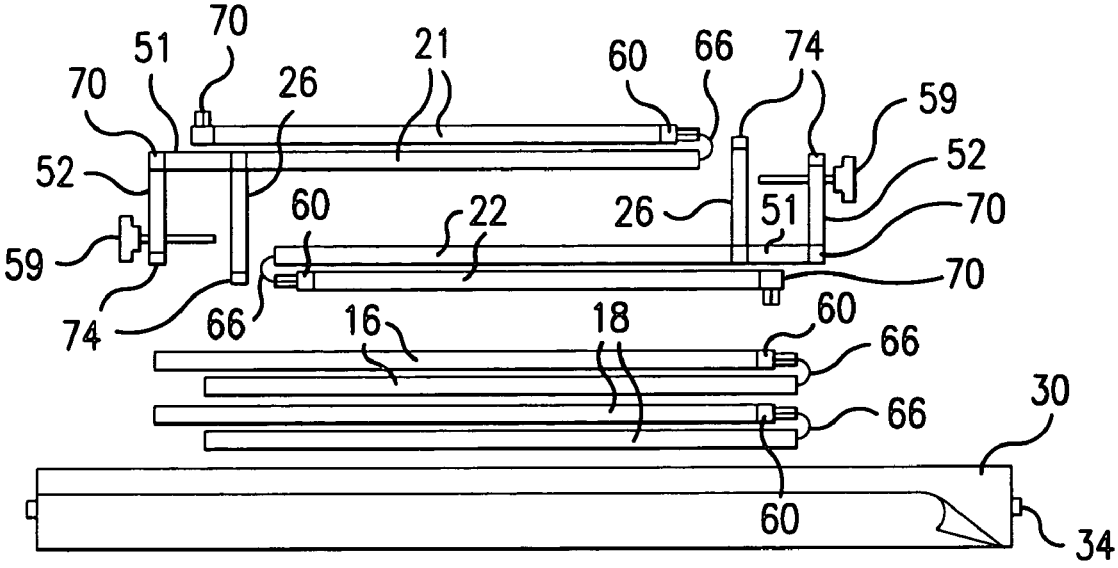
FIG. 8A is a perspective view of the modular table top display apparatus disassembled prior to insertion into a carrying case.
Figure 8B:
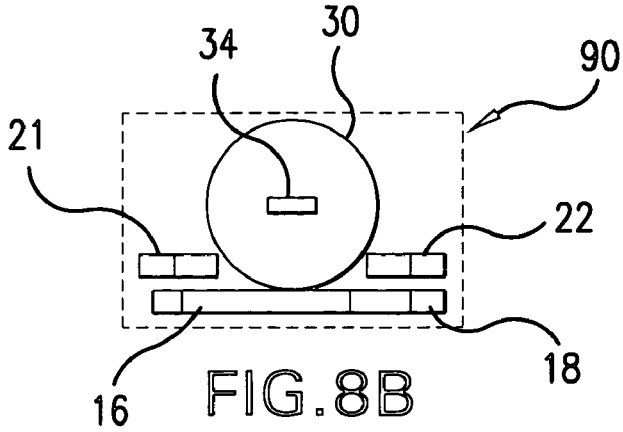
FIG. 8B is a view of the carrying case with the modular table top display apparatus, enclosed therein.
Figure 9A:
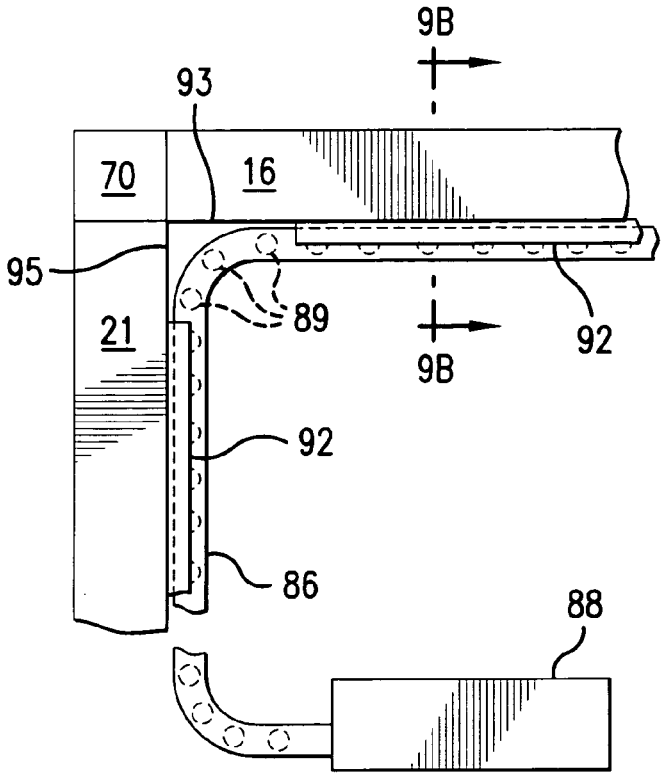
FIG. 9A is a perspective view of multiple lights secured to the frame.
Figure 9B:
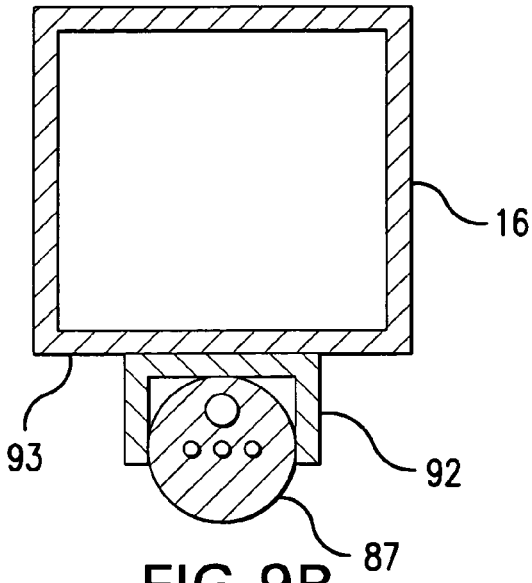
FIG. 9B is a cross-sectional view of the multiple light assembly taken along lines 9B–9B in FIG. 9A.

To remove the assembled frame 15, the first and second clamping means 50 are each loosened, and the assembled frame 15 is lowered into a horizontal position, on either the floor or upon the table top 12. The flexible sheet material 30 is then removed from the frame 15, and rolled up. The horizontal cross members 16, 18 are then removed from the first and second upright sub-assemblies 20, 40, and the component parts are placed in a suitable container 90, for shipping or storage, as shown in FIG. 8B.

Thus, while a preferred embodiment of the modular table top apparatus 10 has been disclosed, one of average skill in this art may make numerous changes and modifications without departing from the scope of this invention, and such changes or modifications are intended to fall within the scope of the following claims.

PARTS LIST

10—Modular table top display apparatus
11—existing table
12—table top
13—underside of table top
14—table legs
15—frame
16—upper horizontal cross member
17—depending lip of table top
18—lower horizontal cross member
19—tubular members
20—first upright sub-assembly
21—first vertical tubular member
22—second vertical tubular member
23—upper end of vertical tubular member
24—opposing ends
25—lower end of vertical tubular member
26—table top brace
27—distal end of table top brace
28—front side
29—rear side
30—flexible sheet material
31—indicia
32—horizontal spacer
33—releasable securement means
34—rigid member
38—opposing sides
40—second upright sub-assembly
42—lower end of threaded rod

44—upper portion of threaded rod
46—rigidly secured
47—pivot
48—pivotally secured
49—lower end of lower extension
50—clamping means
51—lower extension
52—horizontal clamping arm
53—vertical aperture
54—threaded nut
55—threaded rod or bolt
58—cap
59—handle
60—straight connector
61—slip fit connection
62—press fit connection
63—central portion
65—distal end of clamping arm
66—elastomeric cord
67—threaded bolt
68—distal end of threaded rod
70—right angle connector
71—slip fit connection
72—press fit connection
73—central portion
74—end connector
75—press fit connector
76—pivoting connection
77—circular end
78—press fit connection
79—pivot aperture
80—lower four way connector
81—slip fit connection
82—press fit connection
83—central portion
84—light fixture
86—multiple light cord assembly
87—light string
88—controller
89—points of light
90—container
92—U-shaped channel member

What is claimed is:

1. A modular table top display apparatus to be supported and secured to a new or existing table top, which comprises:

a) a first upright sub-assembly, comprising at least one vertical tubular member, a upper connector secured to the upper end of the first vertical tubular member, and a lower connector secured to the lower end of the vertical tubular member;

b) a first clamping means positioned beneath the first upright sub-assembly, the first clamping means having a horizontal table top brace, a depending lower extension, and a horizontal clamping arm with a vertical aperture located near the distal end of the horizontal clamping arm, a threaded nut secured within the horizontal clamping arm in alignment with the vertical aperture, a threaded rod engaging the threaded nut, and extending through the vertical aperture, a handle secured to the lower end of the threaded rod, the threaded rod sized to engage the bottom of the table top when the handle is tightened, and to clear the depending lip of the table top when the handle is loosened;

c) a second upright sub-assembly, comprising at least one vertical tubular member, an upper connector secured to the upper end of the vertical tubular member, and a lower connector secured to the lower end of the vertical tubular member;

d) a second clamping means positioned beneath the second upright sub-assembly, the clamping means having a horizontal table top brace, a depending lower extension, and a horizontal clamping arm with a vertical aperture located near the distal end of the horizontal clamping arm, a threaded nut secured within the horizontal clamping arm in alignment with the vertical aperture, a threaded rod engaging the threaded nut, and extending through the vertical aperture, a handle secured to the lower end of the threaded rod, the upper end of the threaded rod sized to engage the bottom of the table top when the handle is tightened, and to clear the depending lip of the table top when the handle is loosened;

e) at least one upper horizontal cross member, the upper horizontal cross member(s) sized to extend between the connector secured to the upper end of the first upright sub-assembly and the connector secured to the upper end of the second upright sub-assembly;

f) at least one lower horizontal cross member(s), the lower horizontal cross member(s) sized to extend between the lower connector secured to the lower end of the first upright sub-assembly and the lower connector secured to the lower end of the second upright sub-assembly;

g) a flexible sheet material sized to be releasably secured to a frame formed by the vertical tubular member on the first upright sub-assembly, the vertical tubular member on the second upright sub-assembly, the upper horizontal cross member and the lower horizontal cross member at assembly, and;

h) the horizontal clamping arms of the first and second upright sub-assemblies are pivotal in relation to the respective first and second upright sub-assemblies, to position the clamp means to avoid objects located on the underside of the table top.

2. The modular table top display apparatus of claim 1, wherein two vertical tubular member(s) are used to extend the height of the respective first and second upright sub-assemblies, and to provide a more compact disassembly, for ease of transport and storage.

3. The modular table top display apparatus of claim 2, wherein an elastomeric cord is secured between adjacent vertical tubular members for ease of alignment and assembly.

4. The modular table top display apparatus of claim 1, wherein two horizontal cross member(s) are used to extend the length of the modular table top display apparatus, and to provide a more compact disassembly, for ease of transport and storage.

5. The modular table top display apparatus of claim 4, wherein an elastomeric cord is secured between adjacent horizontal cross members for ease of alignment and assembly.

6. The modular table top display apparatus of claim 1, wherein at least one light fixture is releasably secured to the upper portion of the frame to selectively illuminate the modular table top display apparatus.

7. The modular table top display apparatus of claim 1, wherein a multiple light cord assembly is secured to the frame formed by the lower portion of the upper horizontal cross member, the upper portion of the lower horizontal cross member, the inner side of the first vertical tubular member, and the inner side of the second vertical tubular member, thus forming a substantially continuous multiple light cord assembly having multiple points of light positioned within the frame to aid in illuminating the flexible sheet material located within the modular table top display apparatus, and a controller is provided to selectively control the actuation of the multiple lights.

8. The modular table top display apparatus of claim 1, wherein at least one end of a straight connector, a right angle connector, and a four way connector is slotted in at least one direction to provide a slip fit connection.

9. The modular table top display apparatus of claim 1, wherein an end connector is provided to close off the distal end of each of the horizontal clamping arms.

10. The modular table top display apparatus of claim 1, wherein the position of the clamping arms are offset in relation to the vertical tubular member on each of the first and second upright sub-assemblies to position the clamp arm at least four inches inward of the opposing ends of the table top to position the clamping means to avoid obstacles located underneath the table top.

11. A modular table top display apparatus to be supported and secured to a new or existing table top, which comprises:

a) a first upright sub-assembly, comprising at least one vertical tubular member, an upper connector secured to the upper end of the vertical tubular member, and a lower connector secured to the lower end of the at least one vertical tubular member, a horizontal spacer secured to the lower end of the right angle connector, with a first end of a four way connector secured to the horizontal spacer on one side, and a slip fit connector end secured to the opposite side;

b) a first clamping means positioned beneath the four way connector, the first clamping means having a horizontal table top brace extending at right angles to the horizontal extension and secured to the four way connector, a depending vertical extension secured to the four way connector, a right angle connector secured to the lower end of the depending vertical extension, and a horizontal clamping arm secured to the right angle connector and extending in spaced relation beneath the horizontal table top brace; a vertical aperture located near the distal end of the horizontal clamping arm, a threaded nut secured within the horizontal clamping arm in alignment with the vertical aperture, a threaded rod engaging the threaded nut, and extending through the vertical aperture, a handle secured to the lower end of the threaded rod, the threaded rod sized to engage the bottom of the table top when tightened, and to clear the depending lip of the table top when loosened;

c) a second upright sub-assembly, comprising at least one vertical tubular member, an upper connector secured to the upper end of the vertical tubular member, and a lower connector secured to the lower end of the at least one vertical tubular member, a horizontal spacer secured to the lower end of the right angle connector, with a first end of a four way connector secured to the horizontal spacer on one side, and a slip fit connector end secured to the opposite side;

d) a second clamping means positioned beneath the four way connector, the second clamping means having a horizontal table top brace extending at right angles to the horizontal extension, a depending vertical extension secured to the four way connector, and a right angle connector secured to the lower end of the depending vertical extension, a horizontal clamping arm secured to the right angle connector and extending in spaced relation beneath the horizontal table top brace; a vertical aperture located near the distal end of the horizontal clamping arm, a threaded nut secured within the horizontal clamping arm in alignment with the vertical aperture, a threaded rod engaging the threaded nut, and extending through the vertical aperture, a handle secured to the lower end of the threaded rod, the threaded rod sized to engage the bottom of the table top when tightened, and to clear the depending lip of the table top when loosened;

e) at least one upper horizontal cross member(s), the upper horizontal cross member(s) sized to extend between the right angle connector secured to the upper end of the first upright sub-assembly and the right angle connector secured to the upper end of the second upright sub-assembly;

f) at least one lower horizontal cross member(s), the lower horizontal cross member(s) sized to extend between the lower connector secured to the lower end of the first upright sub-assembly and the lower connector secured to the lower end of the second upright sub-assembly;

g) and a flexible display sheet sized to be releasably secured to the vertical tubular member on the first upright sub-assembly, the vertical tubular member on the second upright sub-assembly, the upper horizontal cross member and the lower horizontal cross member at assembly.

12. The modular table top display apparatus of claim 11, wherein the horizontal clamping arms of the first and second upright sub-assemblies are pivotal in relation to the respective first and second upright sub-assemblies, to position the clamp means to avoid apparatus located on the underside of the table top.

13. The modular table top display apparatus of claim 11, wherein a multiple light cord assembly is secured to the lower portion of the upper horizontal cross member, the upper portion of the lower horizontal cross member, the inner side of the first vertical tubular member, and the inner side of the second vertical tubular member, thus forming a substantially continuous multiple light cord assembly having multiple points of light positioned within the frame to aid in illuminating the flexible sheet material located within the modular table top display apparatus, and a controller is provided to selectively control the actuation of the multiple lights.

14. The modular table top display apparatus of claim 11, wherein at least one end of each straight connector, right angle connector, and four way connector is slotted in at least one direction to provide a slip fit connection.

15. The modular table top display apparatus of claim 11, wherein an end connector is provided to close off the open end of each of the table top braces and the clamping arms.

16. A modular table top display apparatus to be supported and secured to a new or existing table top, which comprises:

a) a first upright sub-assembly, comprising at least one vertical tubular member, a right angle connector secured to the upper end of the vertical tubular member, and a lower connector secured to the lower end of the vertical tubular member;

b) a first clamping means positioned beneath the first upright sub-assembly, the first clamping means having a horizontal table top brace, a depending lower extension, a pivotal connecting means pivotally secured within the depending lower extension, and a pivotal horizontal clamping arm secured to the pivotal connecting means, with a vertical aperture located near the distal end of the pivotal horizontal clamping arm, a threaded nut secured within the pivotal horizontal clamping arm in alignment with the vertical aperture, a threaded rod engaging the threaded nut, the threaded rod extending through the vertical aperture, a handle secured to the lower end of the threaded rod, the threaded rod sized to engage the bottom of the table top when tightened, and to clear the depending lip of the table top when loosened;

c) a second upright sub-assembly, comprising at least one vertical tubular member, a right angle connector secured to the upper end of the vertical tubular member, and a lower connector secured to the lower end of the vertical tubular member;

d) a second clamping means positioned beneath the second upright sub-assembly, the second clamping means having a horizontal table top brace, a depending lower extension, a pivotal connecting means pivotally secured within the depending lower extension, and a pivotal horizontal clamping arm secured to the pivotal connecting means, with a vertical aperture located near the distal end of the pivotal horizontal clamping arm, a threaded nut secured within the pivotal horizontal clamping arm in alignment with the vertical aperture, a threaded rod engaging the threaded nut, and extending through the vertical aperture, a handle secured to the lower end of the threaded rod, the threaded rod sized to engage the bottom of the table top when tightened, and to clear the depending lip of the table top when loosened;

e) at least one upper horizontal cross member(s), the upper horizontal cross member(s) sized to extend between the right angle connector secured to the upper end of the first upright sub-assembly and the right angle connector secured to the upper end of the second upright sub-assembly;

f) at least one lower horizontal cross member(s), the lower horizontal cross member(s) sized to extend between the lower connector secured to the lower end of the first upright sub-assembly and the lower connector secured to the lower end of the second upright sub-assembly;

g) and a flexible sheet material sized to be releasably secured to the vertical tubular member on the first upright sub-assembly, the vertical tubular member on the second upright sub-assembly, the upper horizontal cross member and the lower horizontal cross member at assembly.

17. The modular table top display apparatus of claim 16, wherein the position of the table top brace, the lower extension and the clamping arm are offset in relation to the vertical tubular member on each of the first and second upright sub-assemblies to position the clamp arm at least four inches inward of the opposing ends of the table top to avoid obstacles located underneath the table top.

18. The modular table top display apparatus of claim 16, wherein a multiple light cord assembly is secured to the lower portion of the upper horizontal cross member, the upper portion of the lower horizontal cross member, the inner side of the first vertical tubular member, and the inner side of the second vertical tubular member, thus forming a substantially continuous multiple light cord assembly having multiple points of light positioned within the frame to aid in illuminating the flexible sheet material located within the modular table top display apparatus, and a controller is provided to selectively control the actuation of the multiple lights.

19. The modular table top display apparatus of claim 16, wherein an end connector is provided to close off the open end of each of the table top braces and the clamping arms.

* * * * *